US010283300B2

(12) United States Patent
Rodriquez Salinas

(10) Patent No.: US 10,283,300 B2
(45) Date of Patent: May 7, 2019

(54) BIMETAL PLATE TO PROVIDE TWO DIFFERENT CURRENT RATINGS WITHIN FRAME OF CIRCUIT BREAKER

(71) Applicant: Siemens Industry, Inc., Alpharetta, GA (US)

(72) Inventor: Juan Jose Rodriquez Salinas, Monterrey (MX)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/717,333

(22) Filed: Sep. 27, 2017

(65) Prior Publication Data

US 2019/0096618 A1 Mar. 28, 2019

(51) Int. Cl.

| | |
|---|---|
| ***H01H 37/52*** | (2006.01) |
| ***H01H 71/10*** | (2006.01) |
| ***H01H 71/16*** | (2006.01) |

(52) U.S. Cl.

CPC ..... *H01H 71/1081* (2013.01); *H01H 37/52* (2013.01); *H01H 71/164* (2013.01); *H01H 2037/526* (2013.01)

(58) Field of Classification Search

CPC ..... H01H 37/52; H01H 37/521; H01H 2037/5463; H01H 71/1081; H01H 71/164

USPC ..... 337/360

See application file for complete search history.

(56) References Cited

U.S. PATENT DOCUMENTS

| | | | | |
|---|---|---|---|---|
| 2,122,693 A * | 7/1938 | Maseng | H01H 71/16 | 337/111 |
| 2,629,796 A * | 2/1953 | Kern | H01H 71/405 | 200/51 R |
| 4,105,986 A * | 8/1978 | Gogniat | H01H 71/16 | 337/3 |
| 4,414,529 A * | 11/1983 | Yoshioka | H01H 37/006 | 337/36 |
| 4,510,479 A * | 4/1985 | Merchant | H01H 73/30 | 337/372 |
| 4,922,220 A * | 5/1990 | Livesey | H01H 71/74 | 335/45 |
| 6,353,526 B1 * | 3/2002 | Pellon | H01H 71/162 | 337/57 |
| 2015/0028991 A1 * | 1/2015 | Chora De La Garza | H01H 71/164 | 337/360 |

* cited by examiner

*Primary Examiner* — Jacob R Crum

(57) ABSTRACT

A circuit breaker having a frame comprises a bimetal plate having a longitudinal length wherein the bimetal plate is cut along the longitudinal length into a narrow section and a wider section both being parallel to each other such that the bimetal plate is configured to control when and how a trip mechanism of a trip unit activates. The circuit breaker comprises a heating element coupled to the bimetal plate to heat the narrow section and the wider section when a current goes through the heating element. The narrow section and the wider section of the bimetal plate to deflect differently when a same amount of heat is applied in a same amount of time to control when and how the trip mechanism activates such that to allow to have two different current ratings in the frame in that the bimetal plate allows to increment a current protection level from a lower current rating to a higher current rating.

16 Claims, 6 Drawing Sheets

BIMETAL PLATE TO PROVIDE TWO DIFFERENT CURRENT RATINGS WITHIN FRAME OF CIRCUIT BREAKER

BACKGROUND

1. Field

Aspects of the present invention generally relate to a circuit breaker and more specifically relate to a bimetal plate adapted to be used in circuit breakers.

2. Description of the Related Art

Within circuit breakers, one or more moveable electrical contacts may be provided. Such electrical contacts, in some circuit breaker configurations, may be electrically coupled by one or more flexible conductors to a heater-bimetal assembly. The heater-bimetal assembly functions to trip the circuit breaker when a persistent over-current situation is encountered in the electrical circuit protected by the circuit breaker. Tripping involves resistive heating of a heating element, which, in turn, heats a bimetal element thereby causing bending of a bimetal element. Upon bending, the bimetal element makes engaging contact with a portion of a trip mechanism, and if sufficient heating is present will resultantly trip the circuit breaker. This opens the electrical contacts thereby opening the protected circuit.

Currently to modify the current rating of thermal protection we need to modify the bimetal plate of a heater element of a circuit breaker. Until now the solution to control when a trip unit is activated is made by two means, the first is to use a different bimetal for every rating current protected and the second one is changing the properties of the heater to generate the heat required for the bimetal plate to act at different current ratings.

So there is a big quantity of catalogue products since there is one item for every bimetal configuration. However, this problem creates a solution that involves having a big inventory and a complex logistics process to produce the final product and to provide the material source.

Therefore, there is a need for efficiently producing a trip unit of a circuit breaker that is capable to thermally protecting the circuit at two current ratings, meaning it provides dual thermal protection.

SUMMARY

Briefly described, aspects of the present invention relate to dividing a bimetal in two parts wherein the size of the sections of the bimetal is to be selected according by the protection ratings required. Embodiments of the present invention provide a solution that produces a trip unit capable of thermally protecting the circuit at two current ratings which means it can provide dual thermal protection. This technique provides a way to reduce the catalogue of products since the trip unit will make possible to offer a product capable of covering two different current ratings.

In accordance with one illustrative embodiment of the present invention, a circuit breaker having a frame is provided. The circuit breaker comprises a bimetal plate having a longitudinal length and a heating element coupled to the bimetal plate to heat a narrow section and a wider section when a current goes through the heating element. The bimetal plate is cut along the longitudinal length into the narrow section and the wider section both being parallel to each other such that the bimetal plate is configured to control when and how a trip mechanism of a trip unit activates. The narrow section and the wider section of the bimetal plate to deflect differently when a same amount of heat is applied in a same amount of time to control when and how the trip mechanism activates such that to allow to have two different current ratings in the frame in that the bimetal plate allows to increment a current protection level from a lower current rating to a higher current rating.

In accordance with another illustrative embodiment of the present invention, a circuit breaker having a frame is provided. The circuit breaker comprises a trip unit including a trip mechanism having a trip bar with a tip, a bimetal plate having a longitudinal length, a heating element coupled to the bimetal plate to heat a narrow section and a wider section when a current goes through the heating element and a selector configured to rotate to a low current position and a high current position in order to pick the current protection level from two options. The bimetal plate is cut along the longitudinal length into a narrow section and a wider section both being parallel to each other such that the bimetal plate is configured to control when and how the trip mechanism of the trip unit activates and wherein the bimetal plate comprises a union of two different metal layers with different thermal expansion coefficients. The narrow section and the wider section of the bimetal plate to deflect differently when a same amount of heat is applied in a same amount of time to control when and how the trip mechanism activates such that to allow to have two different current ratings in the frame in that the bimetal plate allows to increment a current protection level from a lower current rating to a higher current rating.

In accordance with yet another illustrative embodiment of the present invention, a method is provided. The method comprises providing a trip unit including a trip mechanism having a trip bar with a tip, providing a bimetal plate having a longitudinal length, providing a heating element coupled to the bimetal plate to heat a narrow section and a wider section when a current goes through the heating element, and providing a selector configured to rotate to a low current position and a high current position in order to pick the current protection level from two options. The bimetal plate is cut along the longitudinal length into a narrow section and a wider section both being parallel to each other such that the bimetal plate is configured to control when and how the trip mechanism of the trip unit activates and wherein the bimetal plate comprises a union of two different metal layers with different thermal expansion coefficients. The narrow section and the wider section of the bimetal plate to deflect differently when a same amount of heat is applied in a same amount of time to control when and how the trip mechanism activates such that to allow to have two different current ratings in the frame in that the bimetal plate allows to increment a current protection level from a lower current rating to a higher current rating.

Still other aspects, features, and advantages of the present invention may be readily apparent from the following description by illustrating a number of example embodiments and implementations. The present invention may also be capable of other and different embodiments, and its details may be modified in various respects, all without departing from the substance and scope of the present invention. The invention covers all modifications, equivalents, and alternatives falling within the substance and scope of the invention.

DETAILED DESCRIPTION

Figure 1:
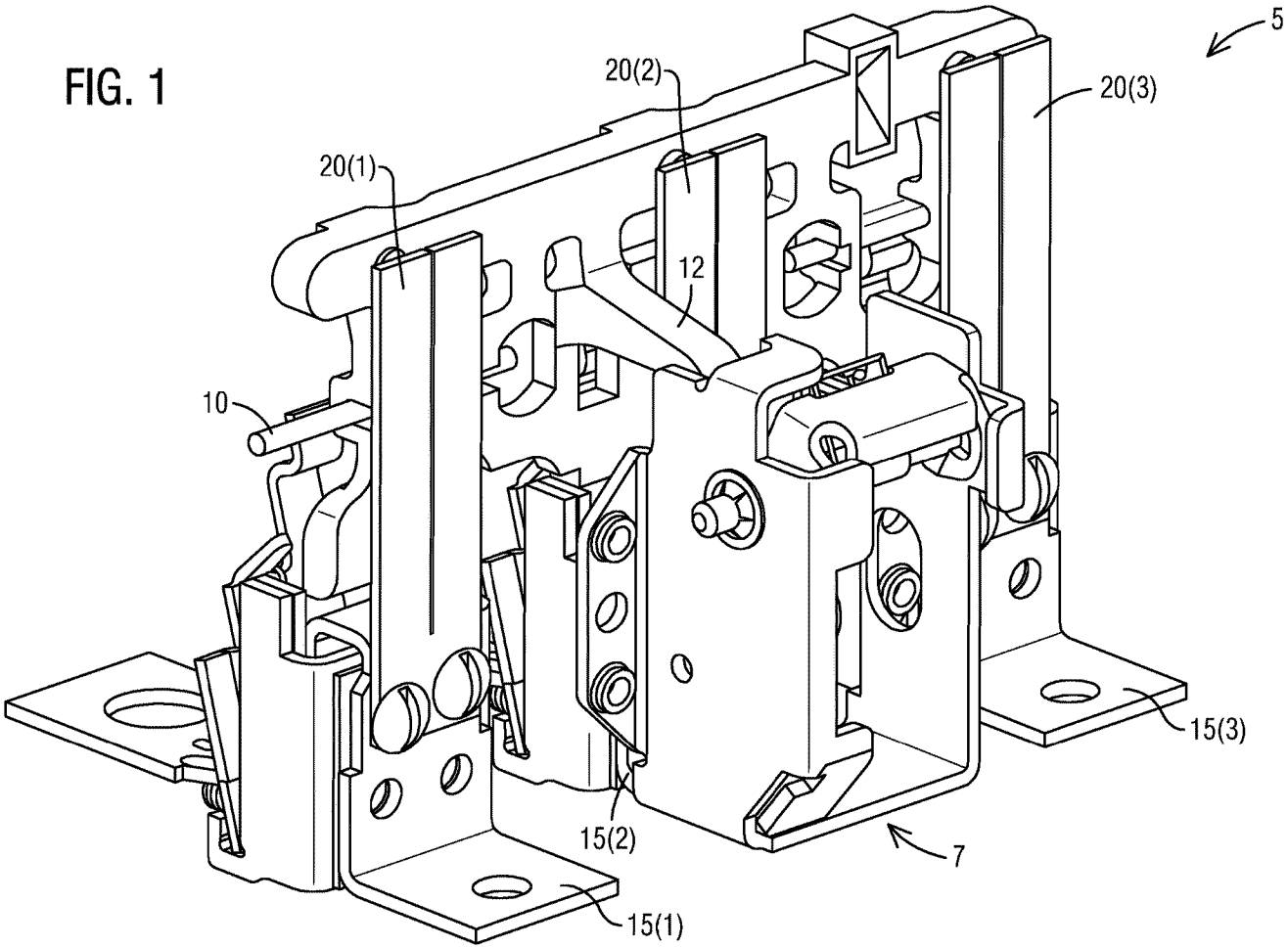
FIG. 1 illustrates a schematic diagram of a 3-pole circuit breaker in accordance with an exemplary embodiment of the present invention.

To facilitate an understanding of embodiments, principles, and features of the present invention, they are explained hereinafter with reference to implementation in illustrative embodiments. In particular, they are described in the context of a bimetal plate that is cut in two parallel sections to provide two different current ratings within a frame of a circuit breaker. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of a circuit breaker are described below with reference to FIGS. 1-13. The drawings are not necessarily drawn to scale. Like reference numerals are used throughout to denote like elements.

Consistent with one embodiment of the present invention, FIG. 1 represents a schematic diagram of a 3-pole circuit breaker 5 in accordance with an exemplary embodiment of the present invention. Although a 3-pole circuit breaker is shown, however the present invention may be implemented in one or more poles circuit breakers. The 3-pole circuit breaker 5 comprises a trip unit 7 including a trip mechanism, a trip bar 10 having a latch 12. The 3-pole circuit breaker 5 comprises a set of heating elements 15(1-3) coupled to a corresponding set of bimetal plates 20(1-3). Each bimetal plate 20 is cut in two parallel sections to provide two different current ratings within a frame (not shown) of the 3-pole circuit breaker 5.

In operation, as a bimetal plate 20 hits the trip bar 10 it moves in a rotational form causing the latch 12 to go up which releases the trip mechanism and contacts go from close to open. In one embodiment, the bimetal plate 20(1) is sectioned in a 75%:25% ratio. As the current goes through the heating element 15(1) heat goes through the bimetal plate 20(1). More the current means more the heat. When relatively more current goes through the heating element 15(1) the 75% section of the bimetal plate 20(1) will deflect and when relatively less current flows though the heating element 15(1) the 25% section of the bimetal plate 20(1) will deflect. In this way, the 3-pole circuit breaker 5 will have two different current ratings. Current can be controlled to activate faster one of the two sections of the bimetal plate 20(1).

The bimetal plate 20(1) is mechanically connected to the heating element 15(1) which is connected in series with the electrical circuit and which has known heat generating electrical resistance properties wherein the rate of heat generation can be correlated to specific magnitudes of electrical current flow therethrough. The heating element 15(1) conducts some of the generated heat to the bimetal plate 20(1), thereby equally elevating the temperature of both strips which comprise the bimetal plate 20(1). Such heating of the bimetal plate 20(1) causes it to bend out of its planar configuration since the two separate strips, from which the bimetal plate 20(1) is formed, elongate to a different length under such temperature elevation.

The bimetal plate 20(1) is positioned in spaced-apart relationship with respect to the trip bar 10 of the trip unit 7 when no current is flowing through the 3-pole circuit breaker 5. However, when electrical current is flowing through the 3-pole circuit breaker 5, the bimetal plate 20(1) bends toward the trip bar 10. When the electrical current flowing through the 3-pole circuit breaker 5 exceeds the predetermined limit for a predetermined period of time, the bimetal plate 20(1) will bend to such an extent that it engages the trip bar 10 thereby rotating it and tripping the 3-pole circuit breaker 5.

Figure 2:
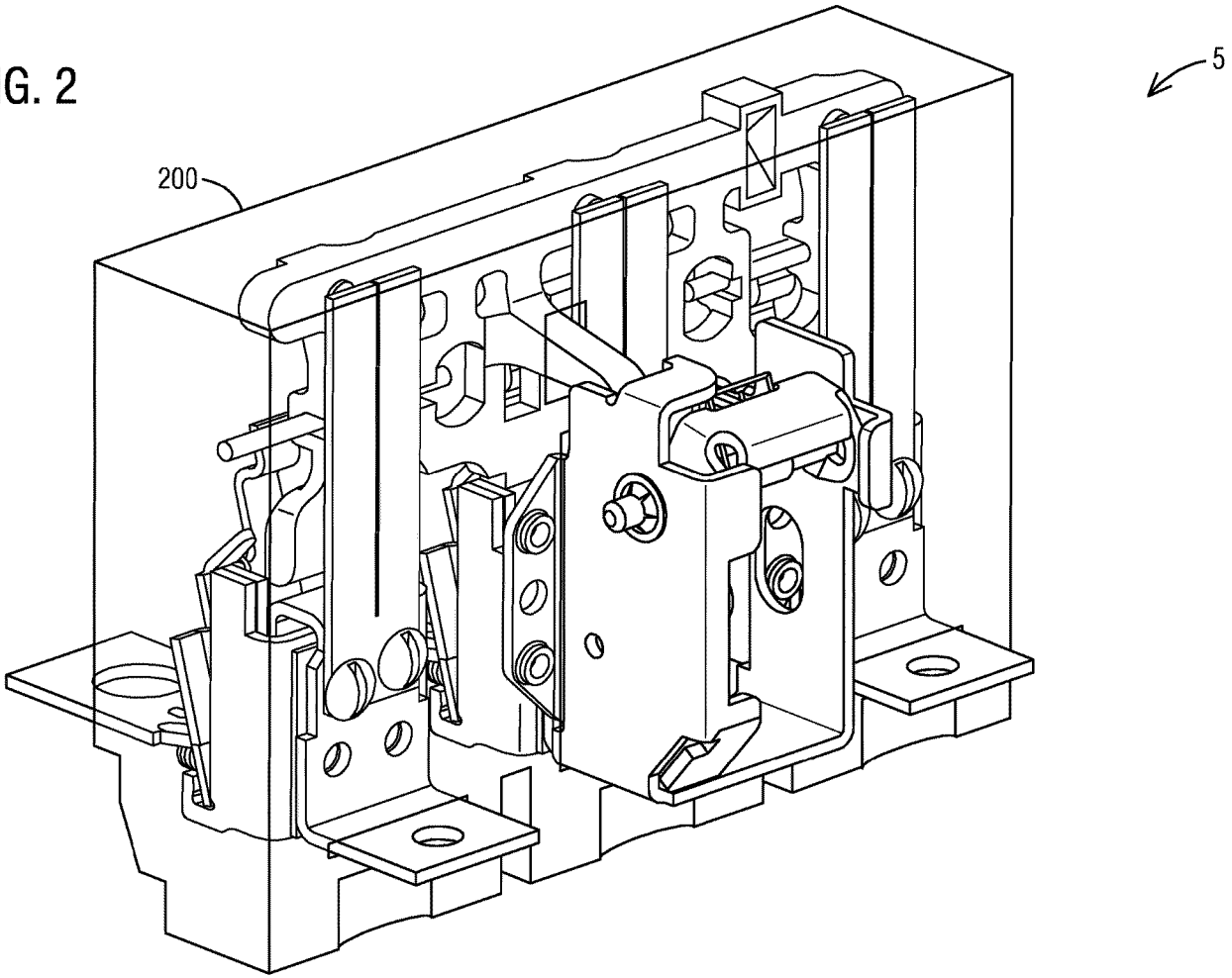
FIG. 2 illustrates a schematic diagram of the 3-pole circuit breaker of FIG. 1 with its details shown in accordance with an exemplary embodiment of the present invention.

Referring to FIG. 2, it illustrates a schematic diagram of the 3-pole circuit breaker 5 of FIG. 1 with its details shown in accordance with an exemplary embodiment of the present invention. The 3-pole circuit breaker 5 includes a cover 200 of the trip unit 7.

Figure 3:
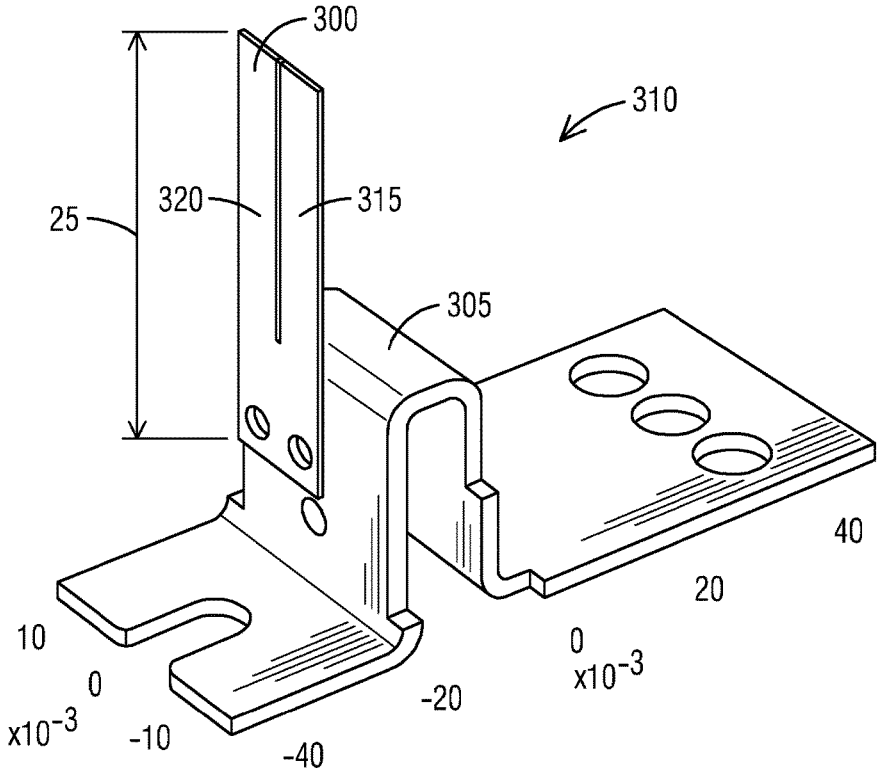
FIG. 3 illustrates a schematic diagram of a bimetal plate and a heating element of a circuit breaker in accordance with an exemplary embodiment of the present invention.

Turning now to FIG. 3, it illustrates a schematic diagram of a bimetal plate 300 and a heating element 305 of a circuit breaker 310 in accordance with an exemplary embodiment of the present invention. By dividing the bimetal plate 300 into two unequal parts such that the size of the two sections of the bimetal plate 300 is to be selected according by the protection ratings required. Embodiments of the present invention provide a solution that produces the trip unit 7 capable of thermally protecting a circuit at two current ratings which means it can provide dual thermal protection. This technique provides a way to reduce the catalogue of products since the trip unit 7 will make possible to offer a product capable of covering two different current ratings.

The bimetal plate 300 has a longitudinal length 25 such that the bimetal plate 300 is cut along the longitudinal length 25 into a narrow section 315 and a wider section 320 both being parallel to each other such that the bimetal plate 300 is configured to control when and how a trip mechanism of the trip unit 7 activates. The heating element 305 is coupled to the bimetal plate 300 to heat the narrow section 315 and the wider section 320 when a current goes through the heating element 305. The narrow section 315 and the wider section 320 of the bimetal plate 300 deflect differently when a same amount of heat is applied in a same amount of time to control when and how the trip mechanism activates such that to allow to have two different current ratings in the frame in that the bimetal plate 300 allows to increment a current protection level from a lower current rating to a higher current rating.

Figure 4:
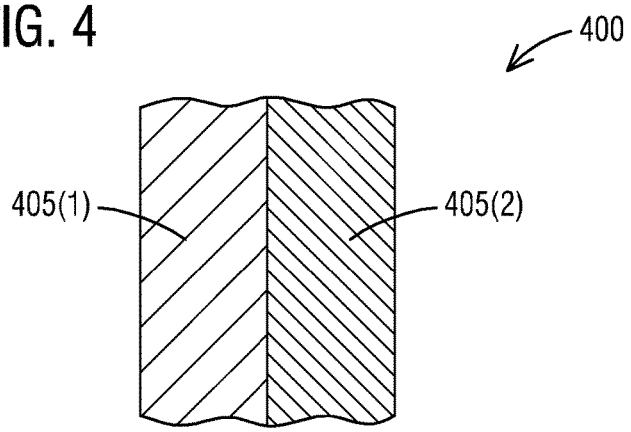
FIG. 4 illustrates a cross sectional view of a bimetal plate that is made of union of two different metals with different thermal expansion coefficients according to an exemplary embodiment of the present invention.

FIG. 4 illustrates a cross sectional view of a bimetal plate 400 that is made of union of two different metal layers 405(1-2) with different thermal expansion coefficients according to an exemplary embodiment of the present invention. See Table I below.

TABLE I

| | | |
|---|---|---|
| 1. | Bimetal 36 22 | First layer: (50%) Low Expansion 36% Ni 64% Fe Second layer: (50%) High Expansion 22% Ni 3% Cu 75% Fe |
| 2. | Bimetal 39 22 | First layer: (50%) Low Expansion 39% Ni 61% Fe Second layer: (50%) High Expansion 22% Ni 3% Cu 75% Fe |
| 3. | Bimetal 42 22 | First layer: (50%) Low Expansion 42% Ni 58% Fe Second layer: (50%) High Expansion 22% Ni 3% Cu 75% Fe |

Regarding the configurations of percentage of bimetal metals vs. applied force, appropriate testing can determine the nature of this relationship which can be exploited based on a specific application. The volume of materials gives different deflections of sections of the bimetal plate 400. One region/section can be smaller than other region/section. Different regions/sections heat at different rates. If a section is heated faster, it deflects more and activates the trip unit 7. The trip unit 7 provides a switch to release mechanism to open contacts of the 3-pole circuit breaker 5 of FIG. 1.

The partitioning of the bimetal plate 400 modifies the performance of the bimetal plate 400. Also there is need to use a new configuration on the trip bar 10 to allow two positions of function. This combination of the bimetal plate 400 and the trip bar 10 will allow having two different rated currents.

The bimetal plate 400 is being used to control when the trip unit 7 activates. Since the bimetal plate 400 will have two different positions it will implement two different current ratings. The bimetal plate 400 deflects in a direct response of the heat in the part but since there are two sections it will have different deflections when the same heat is applied in the same amount of time. This will provide two different current ratings in the same frame of the 3-pole circuit breaker 5 of FIG. 1. It will allow incrementing the current protection without the need to buy a new product. The benefits of the invention can be achieved by a user using a switch interface that enable selecting one of the two different rating of protection available in the 3-pole circuit breaker 5 of FIG. 1.

Figure 5:
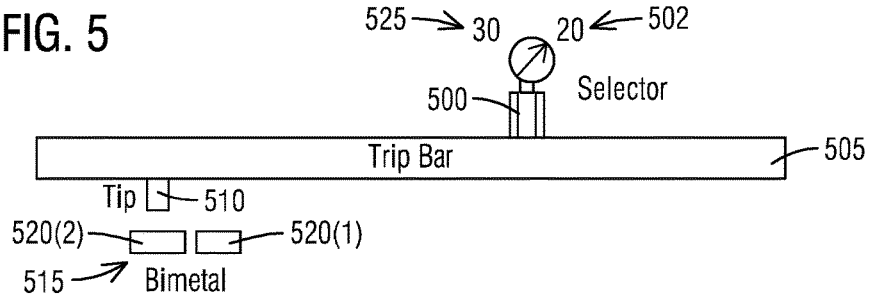
FIG. 5 illustrates an application of a circuit breaker having a selector configured in a low position in accordance with an exemplary embodiment of the present invention.

As seen in FIG. 5, it illustrates an application of a circuit breaker having a selector 500 configured in a low current position 502 in accordance with an exemplary embodiment of the present invention. The selector 500 is coupled to a trip bar 505 having a tip 510. A bimetal plate 515 is situated next to the tip 510. The bimetal plate 515 comprises a narrow section 520(1) and a wider section 520(2). The narrow section 520(1) and the wider section 520(2) of the bimetal plate 515 may have a width size ratio of 40:60 or 30:70. The bimetal plate 515 may be shaped either in a rectangular shape or a trapezoid shape. The trip unit 7 includes the trip mechanism. The bimetal plate 515 is configured to control when and how the trip mechanism of the trip unit 7 activates. The bimetal plate 515 may comprise a union of two different metal layers with different thermal expansion coefficients.

The heating element 15 (not shown) may be coupled to the bimetal plate 515 to heat the narrow section 520(1) and the wider section 520(2) when a current goes through the heating element 15. At the low current position 502, the bimetal plate 515 is given heat by the heating element 15 to deflect the wider section 520(2) of the bimetal plate 515 and make the wider section 520(2) hit the tip 510 of the trip bar 505 of the trip mechanism of the 3-pole circuit breaker 5 of FIG. 1 such that the trip bar 505 is displaced to open the latch (see FIG. 1) which releases the trip mechanism.

Figure 6:
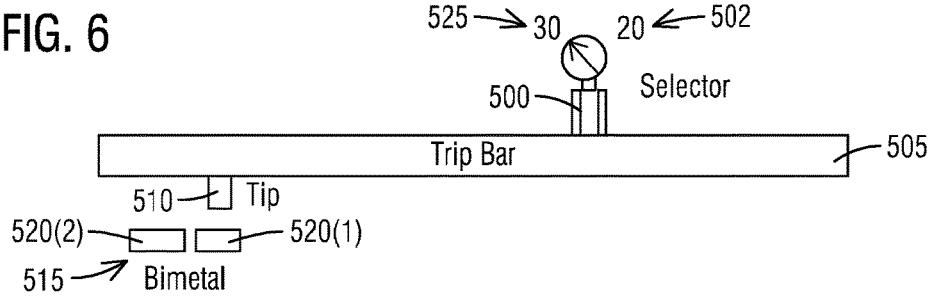
FIG. 6 illustrates an application of a circuit breaker having a selector configured in a high position in accordance with an exemplary embodiment of the present invention.

As shown in FIG. 6, it illustrates an application of a circuit breaker having the selector 500 configured in a high current position 525 in accordance with an exemplary embodiment of the present invention. The selector 500 is configured to rotate to the low current position 502 and the high current position 525 in order to pick the current protection level from two options. At the high current position 525 the bimetal plate 515 is given heat by the heating element 15 (not shown) to deflect the narrow section 520(1) of the bimetal plate 515 and make the narrow section 520(1) hit the tip 510 of the trip bar 505 of the trip mechanism of the 3-pole circuit breaker 5 of FIG. 1 such that the trip bar 505 is displaced to open the latch 12 (not shown) which releases the trip mechanism.

Figure 7:
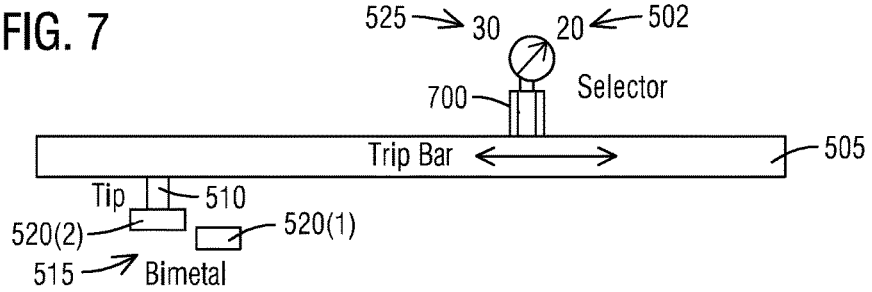
FIG. 7 illustrates a selector of a circuit breaker applying 20 amp current in accordance with an exemplary embodiment of the present invention.

In FIG. 7, it illustrates a selector 700 of a circuit breaker (not shown) applying a 20 amp current in accordance with an exemplary embodiment of the present invention. At the 20 amp current, the heating element 15 will give enough temperature to deflect the bigger or wider section 520(2) of the bimetal plate 515 and hit the tip 510 of the trip bar 505. The 20 amp current will be applied for 1 minute.

Figure 8:
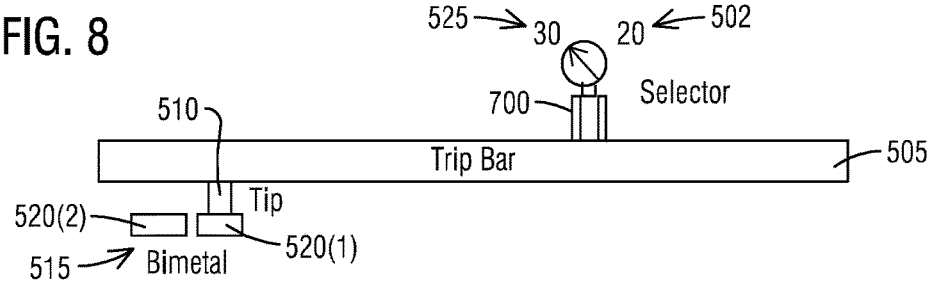
FIG. 8 illustrates a selector of a circuit breaker applying 30 amp current in accordance with an exemplary embodiment of the present invention.

FIG. 8 illustrates the selector 700 of the circuit breaker applying 30 amp current in accordance with an exemplary embodiment of the present invention. At the 30 amp current for the same time of 1 minute, the heating element 15 will give enough temperature to deflect the smaller or narrower section 520(1) to hit the tip 510 of the trip bar 505. Since the tip 510 of the trip bar 505 is displaced, now the trip mechanism will be not activated until this small section or narrower section 520(1) doesn't hit the tip 510 of the trip bar 505.

Figure 9:
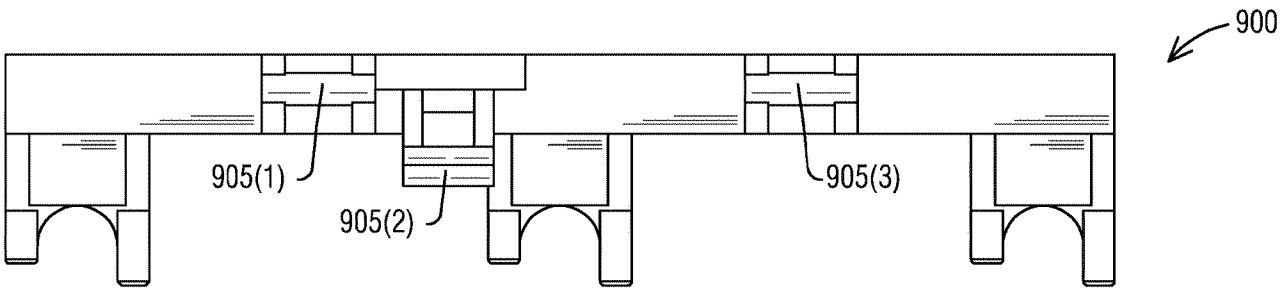
FIG. 9 illustrates a top view of a trip bar of a circuit breaker in accordance with an exemplary embodiment of the present invention.

FIG. 9 illustrates a top view of a trip bar 900 of a circuit breaker in accordance with an exemplary embodiment of the present invention. The trip bar 900 has a new configuration with features 905(1-3) that enables two positions of function in the 3-pole circuit breaker 5. A combination of the bimetal plate 400 and the trip bar 900 enables the 3-pole circuit breaker 5 having two different rated currents.

Figure 10:
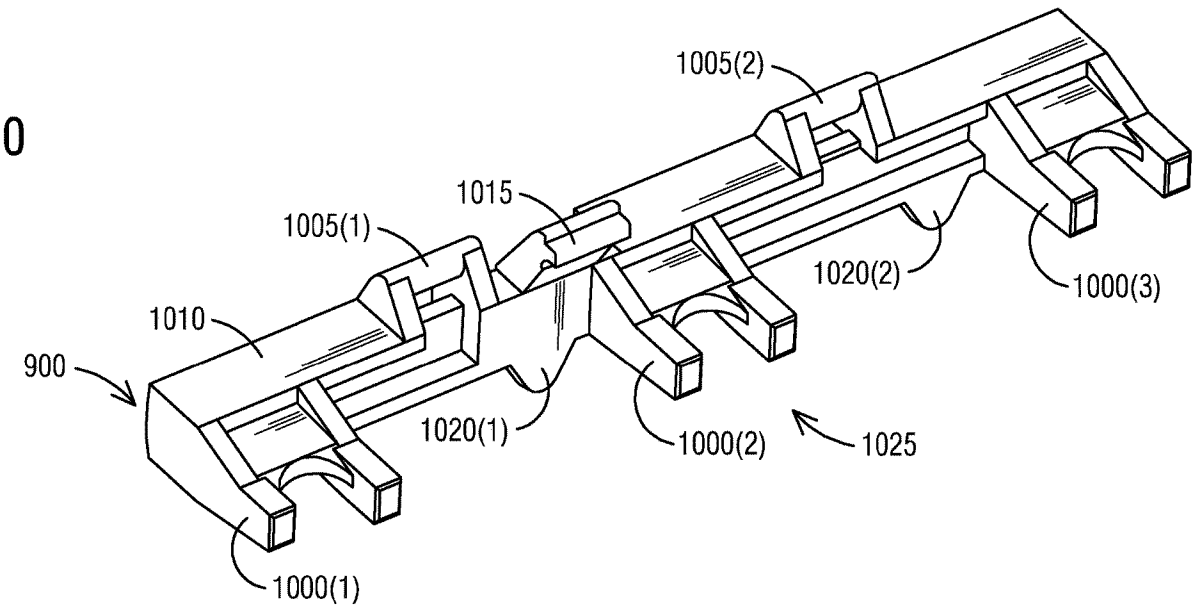
FIG. 10 illustrates a perspective view of the trip bar of FIG. 9 in accordance with an exemplary embodiment of the present invention.

FIG. 10 illustrates a perspective view of the trip bar 900 of FIG. 9 in accordance with an exemplary embodiment of the present invention. The trip bar 900 includes a plurality of first features 1000(1-3) for 3 poles. The trip bar 900 further includes a pair of projections 1005(1-2) on a top surface 1010 of the trip bar 900. The trip bar 900 further includes an angled projection 1015 on the top surface 1010 of the trip bar 900 and in between the pair of projections 1005(1-2).

The trip bar 900 further includes a pair of projections 1020(1-2) extending away from a bottom side 1025 of the trip bar 900.

The bimetal plate 515 may be shaped in different forms depending upon a particular requirement of current ratings. For example, the bimetal plate 515 may be either in a rectangular shape or a trapezoid shape.

Figure 11:
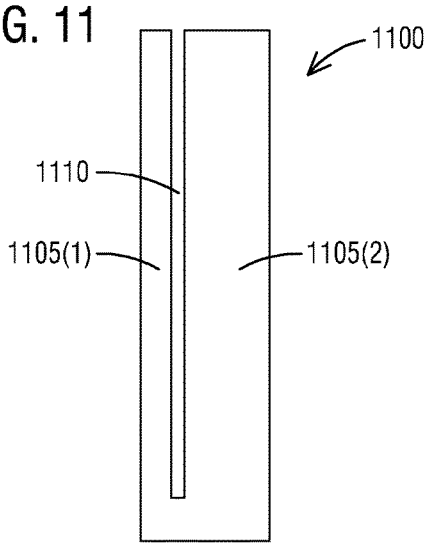
FIG. 11 illustrates a sectioned bimetal plate according to a first embodiment of the present invention.

As indicated in FIG. 11, it illustrates a first sectioned bimetal plate 1100 according to a first embodiment of the present invention. The first sectioned bimetal plate 1100 has two parallel sections 1105(1-2) formed by a cut 1110 in a rectangular shape. The left section 1105(1) is a narrower one and the right section 1105(2) in a wider one. The two parallel sections 1105(1-2) has a ratio of width as 25%:75%. Other such ratios of widths are also contemplated by the embodiments of the present invention based on a choice of different levels of current ratings.

Figure 12:
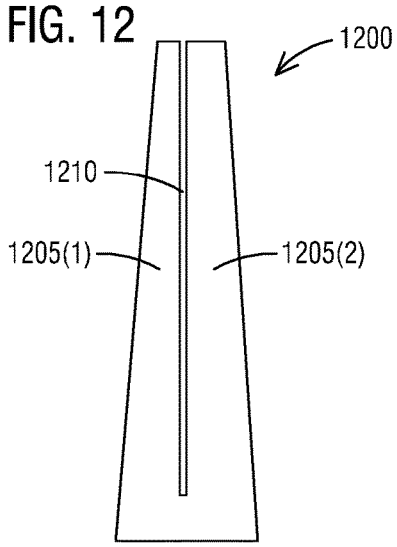
FIG. 12 illustrates a sectioned bimetal plate according to a second embodiment of the present invention.

As further indicated in FIG. 12, it illustrates a second sectioned bimetal plate 1200 according to a second embodiment of the present invention. The second sectioned bimetal plate 1200 has two parallel sections 1205(1-2) formed by a cut 1210 in a trapezoid shape. The left section 1205(1) is a narrower one and the right section 1205(2) in a wider one. The two parallel sections 1205(1-2) has a ratio of width as 33%:66%. Other such ratios of widths are also contemplated by the embodiments of the present invention based on a choice of different levels of current ratings.

Figure 13:
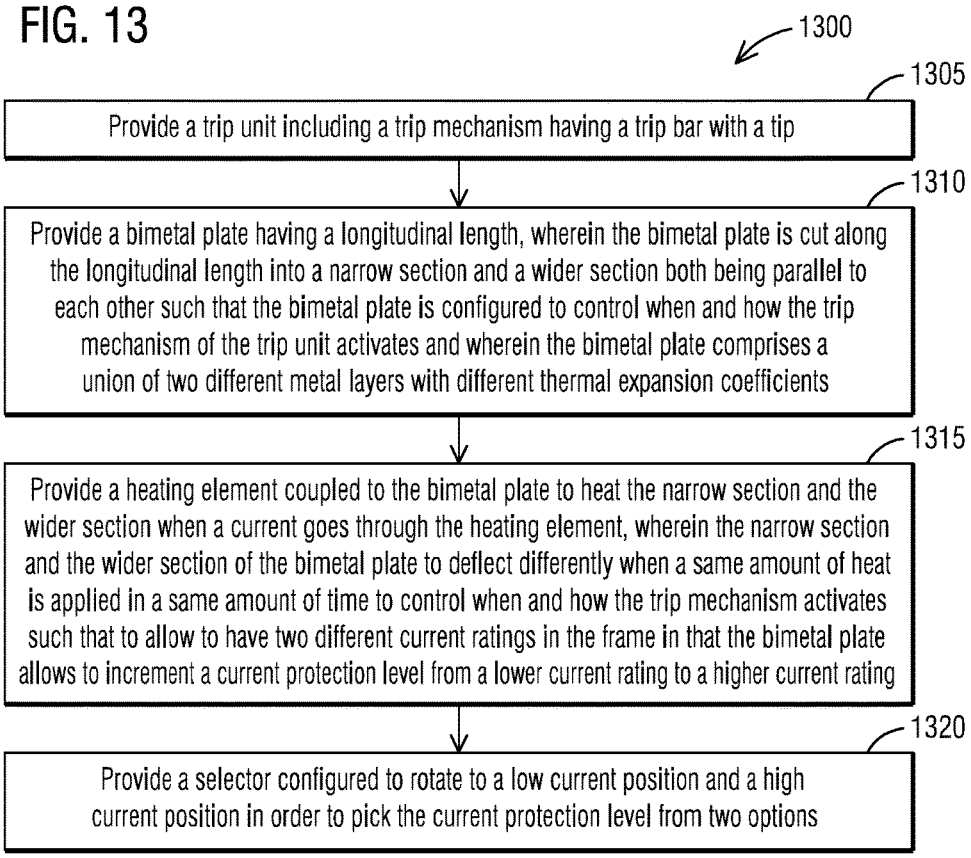
FIG. 13 illustrates a flowchart of a method of sectioning a bimetal plate in two parallel sections to provide two different current ratings within a frame of a circuit breaker according to an exemplary embodiment of the present invention.

FIG. 13 illustrates a flowchart of a method 1300 of sectioning the bimetal plate 515 into two parallel sections 1105(1-2) to provide two different current ratings such as 20 amp or 30 amp within a frame of the 3-pole circuit breaker 5 according to an exemplary embodiment of the present invention. Reference is made to the elements and features described in FIGS. 1-12. It should be appreciated that some steps are not required to be performed in any particular order, and that some steps are optional.

The method 1300 comprises a step 1305 of providing the trip unit 7 including a trip mechanism having the trip bar 505 with the tip 510. The method 1300 further comprises a step 1310 of providing the bimetal plate 515 having a longitudinal length. The bimetal plate 515 is cut along the longitudinal length into a narrow section and a wider section both being parallel to each other such that the bimetal plate 515 is configured to control when and how the trip mechanism of the trip unit 7 activates. The bimetal plate 515 comprises a union of two different metal layers with different thermal expansion coefficients.

The method 1300 further comprises a step 1315 of providing the heating element 15 coupled to the bimetal plate 515 to heat the narrow section and the wider section when a current goes through the heating element 15. The narrow section and the wider section of the bimetal plate 515 to deflect differently when a same amount of heat is applied in a same amount of time to control when and how the trip mechanism activates such that to allow to have two different current ratings in the frame in that the bimetal plate 515 allows to increment a current protection level from a lower current rating to a higher current rating. The method 1300 further comprises a step 1320 of providing the selector 700 configured to rotate to a low current position and a high current position in order to pick the current protection level from two options.

As used herein, "bimetal plate" refers to a bimetallic strip that is used to convert a temperature change into a mechanical displacement. The strip comprises two strips of different metals which expand at different rates as they are heated, usually steel and copper, or in some cases steel and brass. The strips are joined together throughout their length by riveting, brazing or welding. The different expansions force the flat strip to bend one way if heated, and in the opposite direction if cooled below its initial temperature. The metal with the higher coefficient of thermal expansion is on the outer side of the curve when the strip is heated and on the inner side when cooled. Bimetallic strips are used in miniature circuit breakers to protect circuits from excess current. A coil of wire is used to heat a bimetallic strip, which bends and operates a linkage that unlatches a spring-operated contact. This interrupts the circuit and can be reset when the bimetal strip has cooled down. A circuit breaker is an automatically operated electrical switch designed to protect an electrical circuit from damage caused by excess current, typically resulting from an overload or short circuit. A circuit breaker is provided with a first conductive plate fixed with a bimetallic strip attached with a moving contact, a second conductive plate attached with a fixed contact. A bimetallic strip in a circuit breaker bends when a temperature exceeds a specified level which deforms movable plate so as to separate the contacts. The deflection of a bimetallic strip of approximately rectangular configuration is used to provide two different current ratings within a frame of a circuit breaker.

The techniques described herein can be particularly useful for providing two different current ratings within a frame of a circuit breaker. While particular embodiments are described in terms of two different current ratings, the techniques described herein are not limited to just two different current ratings but can also provide multiple current ratings.

Electrical circuit breakers are well known and have been employed for many years to control the flow of electrical current in serially connected electrical circuits. Typically, two modes of operation are provided to control the flow of current in the electrical circuit; a manual mode and an automatic mode.

In the manual mode, a person moves an operating lever between an on position and an off position which closes and opens, respectively, separable contacts within the circuit breaker. This either allows or interrupts the flow of electrical current through the circuit breaker and, thus, through the serially connected electrical circuit.

In the automatic mode of operation, the operating lever is first placed in the on position, thereby allowing electrical current to flow through the circuit breaker. When a predetermined overcurrent condition occurs the circuit breaker automatically opens the separable contacts thereby interrupting the flow of current to the electrical circuit.

The circuit breaker includes an operating mechanism which is mechanically connected to both the operating lever and the separable contacts and which moves the separable contacts between their open and closed positions in response to movement of the operating lever or in response to an automatic signal to open the contacts of the circuit breaker under the prescribed overcurrent conditions. An automatic trip unit is mechanically connected to the operating mechanism and employed to provide such an automatic signal thereby interrupting the flow of electrical current through the circuit breaker and the serially connected electrical circuit, under such prescribed conditions. This is termed "tripping the circuit breaker."

Automatic trip units, generally, employ two different apparatuses to trip the circuit breaker during overcurrent conditions. One such apparatus employs an electromagnet, which is connected to the electrical current path through the circuit breaker. The electromagnet includes a fixed member and a moveable member which develop varying degrees of magnetic flux, therebetween, in relation to the magnitude of current flowing through the circuit breaker. The magnetic flux applies a force to the moveable member and rotates it to an extent determined by the magnitude of electrical current flowing through the electrical circuit. The moveable member is connected to the trip bar of the trip unit and the trip bar trips the circuit breaker when rotated past a prescribed point.

The circuit breaker is assigned a nominal value, termed "rating," which is the maximum continuous magnitude of current which may flow through the circuit breaker without tripping. The electromagnet is designed to immediately trip the circuit breaker when the current flow through the electrical circuit exceeds approximately 500 percent of the rating of the breaker.

A second device employed in the automatic trip unit, which responds to overcurrent conditions of less than 500 percent of the rating of the breaker, is a thermal tripping device. Thermal tripping devices, typically, employ a bimetal strip wherein two different, generally, flat pieces of metal are mechanically attached together and define, generally, a planar surface when the temperature of the strips is equal to the ambient temperature surrounding the circuit breaker. The distinct metals from which each strip is constructed have different thermal expansion coefficients so that they elongate to different lengths whenever their temperatures are elevated above ambient.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A circuit breaker having a frame, the circuit breaker comprising:

a trip unit including a trip mechanism having a trip bar with a tip;

a bimetal plate having a longitudinal length, wherein the bimetal plate is cut along the longitudinal length into a narrow section and a wider section both being parallel to each other such that the bimetal plate is configured to control when and how the trip mechanism of the trip unit activates and wherein the bimetal plate comprises a union of two different metal layers with different thermal expansion coefficients;

a heating element coupled to the bimetal plate to heat the narrow section and the wider section when a current goes through the heating element, wherein the narrow section and the wider section of the bimetal plate to deflect differently when a same amount of heat is applied in a same amount of time to control when and how the trip mechanism activates such that to allow to have two different current ratings in the frame in that the bimetal plate allows to increment a current protection level from a lower current rating to a higher current rating; and a selector configured to rotate to a low current position and a high current position in order to pick the current protection level from two options, wherein the trip bar, the tip, and the selector interact with the narrow section and the wider section of the bimetal plate, including the selector providing a lateral movement of the trip bar and the tip to change which bimetal section will contact the tip and displace the trip bar in the event of an over-current in order to provide the two different current ratings that increment from the lower current rating to the higher current rating by allowing only one of the narrow section and the wider section of the bimetal plate to contact the tip at a time and thereby allows only one current rating to be active at a given time.

2. The circuit breaker of claim 1, wherein at the low current position the bimetal plate is given heat by the heating element to deflect the wider section of the bimetal plate and make the wider section hit a tip of a trip bar of the trip mechanism of the circuit breaker such that the trip bar is displaced to open a latch which releases the trip mechanism.

3. The circuit breaker of claim 1, wherein at the high current position the bimetal plate is given heat by the heating element to deflect the narrow section of the bimetal plate and make the narrow section hit a tip of a trip bar of the trip mechanism of the circuit breaker such that the trip bar is displaced to open a latch which releases the trip mechanism.

4. The circuit breaker of claim 1, wherein the narrow section and the wider section of the bimetal plate having a width size ratio of 40:60 or 30:70 or 33:66 or 25:75.

5. The circuit breaker of claim 1, wherein the bimetal plate is shaped either in a rectangular shape or a trapezoid shape.

6. A method comprising:

providing a trip unit including a trip mechanism having a trip bar with a tip;

providing a bimetal plate having a longitudinal length, wherein the bimetal plate is cut along the longitudinal length into a narrow section and a wider section both being parallel to each other such that the bimetal plate is configured to control when and how the trip mechanism of the trip unit activates and wherein the bimetal plate comprises a union of two different metal layers with different thermal expansion coefficients;

providing a heating element coupled to the bimetal plate to heat the narrow section and the wider section when a current goes through the heating element, wherein the narrow section and the wider section of the bimetal plate to deflect differently when a same amount of heat is applied in a same amount of time to control when and how the trip mechanism activates such that to allow to have two different current ratings in the frame in that the bimetal plate allows to increment a current protection level from a lower current rating to a higher current rating; and providing a selector configured to rotate to a low current position and a high current position in order to pick the current protection level from two options, wherein the trip bar, the tip, and the selector interact with the narrow section and the wider section of the bimetal plate, including the selector providing a lateral movement of the trip bar and the tip to change which bimetal section will contact the tip and displace the trip bar in the event of an over-current in order to provide the two different current ratings that increment from the lower current rating to the higher current rating by allowing only one of the narrow section and the wider section of the bimetal plate to contact the tip at a time and thereby allows only one current rating to be active at a given time.

7. The method of claim 6, wherein at the low current position the bimetal plate is given heat by the heating element to deflect the wider section of the bimetal plate and make the wider section hit a tip of a trip bar of the trip mechanism of the circuit breaker such that the trip bar is displaced to open a latch which releases the trip mechanism.

8. The method of claim 6, wherein at the high current position the bimetal plate is given heat by the heating element to deflect the narrow section of the bimetal plate and make the narrow section hit a tip of a trip bar of the trip mechanism of the circuit breaker such that the trip bar is displaced to open a latch which releases the trip mechanism.

9. The method of claim 6, wherein the narrow section and the wider section of the bimetal plate having a width size ratio of 40:60 or 30:70 or 33:66 or 25:75.

10. The method of claim 6, wherein the bimetal plate is shaped either in a rectangular shape or a trapezoid shape.

11. The circuit breaker of claim 1, wherein the bimetal plate comprises a first layer of 36% Nickel (Ni) and 64% Iron (Fe) with a low thermal expansion coefficient and a second layer of 22% Nickel (Ni), 3% Copper (Cu) and 75% Iron (Fe) with a high thermal expansion coefficient.

12. The circuit breaker of claim 1, wherein the bimetal plate comprises a first layer of 39% Nickel (Ni) and 61% Iron (Fe) with a low thermal expansion coefficient and a second layer of 22% Nickel (Ni), 3% Copper (Cu) and 75% Iron (Fe) with a high thermal expansion coefficient.

13. The circuit breaker of claim 1, wherein the bimetal plate comprises a first layer of 41% Nickel (Ni) and 58% Iron (Fe) with a low thermal expansion coefficient and a second layer of 22% Nickel (Ni), 3% Copper (Cu) and 75% Iron (Fe) with a high thermal expansion coefficient.

14. The method of claim 6, wherein the bimetal plate comprises a first layer of 36% Nickel (Ni) and 64% Iron (Fe) with a low thermal expansion coefficient and a second layer of 22% Nickel (Ni), 3% Copper (Cu) and 75% Iron (Fe) with a high thermal expansion coefficient.

15. The method of claim 6, wherein the bimetal plate comprises a first layer of 39% Nickel (Ni) and 61% Iron (Fe) with a low thermal expansion coefficient and a second layer of 22% Nickel (Ni), 3% Copper (Cu) and 75% Iron (Fe) with a high thermal expansion coefficient.

16. The method of claim 6, wherein the bimetal plate comprises a first layer of 41% Nickel (Ni) and 58% Iron (Fe) with a low thermal expansion coefficient and a second layer of 22% Nickel (Ni), 3% Copper (Cu) and 75% Iron (Fe) with a high thermal expansion coefficient.

* * * * *